US007722728B2

(12) United States Patent
Tsuge et al.

(10) Patent No.: US 7,722,728 B2
(45) Date of Patent: May 25, 2010

(54) HEAT TREATMENT METHOD AND HEAT TREATMENT APPARATUS

(75) Inventors: Takanori Tsuge, Tokyo (JP); Koji Abe, Tokyo (JP)

(73) Assignee: Dowa Mining Co., Ltd., Tokyo (JP)

( * ) Notice: Subject to any disclaimer, the term of this patent is extended or adjusted under 35 U.S.C. 154(b) by 475 days.

(21) Appl. No.: 11/391,310

(22) Filed: Mar. 29, 2006

(65) Prior Publication Data

US 2006/0223015 A1 Oct. 5, 2006

(30) Foreign Application Priority Data

Mar. 31, 2005 (JP) ..... 2005-104403

(51) Int. Cl.
*F23N 1/02* (2006.01)

(52) U.S. Cl. ..... 148/508; 266/78

(58) Field of Classification Search ..... 148/508; 266/44, 78, 90, 99

See application file for complete search history.

(56) References Cited

U.S. PATENT DOCUMENTS 5,231,645 A * 7/1993 Uno et al. ..... 266/90

FOREIGN PATENT DOCUMENTS

JP 05-015782 A 1/1993
JP 2003-013136 A 1/2003

* cited by examiner

*Primary Examiner*—Scott Kastler
(74) *Attorney, Agent, or Firm*—Rader, Fishman & Grauer PLLC

(57) ABSTRACT

In a heat treatment method for supplying transforming gas and enriched gas inside a furnace and heat treating a workpiece inside the furnace, feedback control of carbon potential is performed by operating a supply flow rate of the enriched gas based on carbon potential inside the furnace, the feedback control is stopped before an opening of the furnace is opened and supply flow rates of the transforming gas and the enriched gas are increased from supply flow rates thereof immediately before the feedback control is stopped; and the supply flow rate of the transforming gas is returned to the supply flow rate thereof immediately before the feedback control is stopped and the feedback control is resumed after the opening of the furnace is closed.

5 Claims, 13 Drawing Sheets

FIG.15

| | ECD[mm] |
|---|---|
| EXPERIMENT 1 | 0. 54 |
| COMPARATIVE EXPERIMENT1 | 0. 49 |
| COMPARATIVE EXPERIMENT2 | 0. 37 |

HEAT TREATMENT METHOD AND HEAT TREATMENT APPARATUS

BACKGROUND OF THE INVENTION

1. Field of the Invention

The present invention relates to a heat treatment method and a heat treatment apparatus for steel products.

2. Description of the Related Art

Atmosphere control is important in heat treatment of a steel product, and such atmosphere control is performed by controlling CP (carbon potential) in a heat treatment atmosphere. Conventionally, there is disclosed a method of stabilizing CP at a constant value by controlling a supply amount of enriched gas ($C_mH_n$ gas) based on CP during carburization heat treatment of a steel product (Japanese Patent Publication No. Hei 5-15782). There is also disclosed a method of stabilizing CP by feedback control such as proportional control, PID control or the like (Japanese Patent Application Laid-open No. 2003-013136).

However, in a conventional heat treatment furnace, there is a problem such that when an opening of the furnace is opened for carrying a workpiece in or out, air enters inside the furnace and decreases CP largely. Particularly, there is a problem such that when CP is feedback controlled, a control response (CP) overshoots. Furthermore, there are cases such that a control response becomes unstable to cause hunting, or take a long time to reach a target value.

SUMMARY OF THE INVENTION

An object of the present invention is to provide a heat treatment method and a heat treatment apparatus capable of stabilizing CP inside a furnace.

In order to solve the above-described problems, according to the present invention, a heat treatment method for supplying transforming gas and enriched gas inside a furnace and heat treating a workpiece inside the furnace is provided, which includes the steps of: performing feedback control of carbon potential by operating a supply flow rate of the enriched gas based on carbon potential inside the furnace; stopping the feedback control at any one of before an opening of the furnace is opened, while the opening of the furnace is open, and after the opening of the furnace is closed and before an atmosphere outside the furnace begins to flow into the furnace and increasing a supply flow rate of the transforming gas from a supply flow rate thereof immediately before the feedback control is stopped; and resuming the feedback control when a furnace pressure reaches a predetermined pressure after the opening of the furnace is closed. According to such a heat treatment method, decrease or disturbance of CP inside the furnace can be prevented even when air enters the furnace due to effects of opening/closing the opening.

This heat treatment method may further include the step of returning, when the furnace pressure reaches the predetermined pressure after the opening of the furnace is closed, the supply flow rate of the transforming gas to the supply flow rate thereof immediately before the feedback control is stopped. Furthermore, the heat treatment method may further include the step of increasing, when the feedback control is stopped, the supply flow rate of the enriched gas from a supply flow rate thereof immediately before the feedback control is stopped. In this manner, decrease of CP can be suppressed more effectively.

Further, the opening may be a carry-out port for carrying out a workpiece from the furnace, and the method may further include the steps of: opening the carry-out port of the furnace in a state that an exit of an oil tank chamber provided outside the carry-out port of the furnace is closed and carrying a workpiece into the oil tank chamber; and opening the exit of the oil tank chamber after the carry-out port of the furnace is closed and carrying out the workpiece from the oil tank chamber.

Further, according to the present invention, a heat treatment apparatus for supplying transforming gas and enriched gas inside a furnace and heat treating a workpiece inside the furnace is provided, which includes: a first regulator for regulating an opening degree of a transforming gas flow regulating valve provided on a supply path of the transforming gas and a second regulator for regulating an opening degree of an enriched gas flow regulating valve provided on a supply path of the enriched gas; and a feedback control system including the second regulator for performing feedback control of carbon potential, in which the first regulator increases the opening degree of the transforming gas flow regulating valve at any one of before an opening of the furnace is opened, while the opening of the furnace is open, and after the opening of the furnace is closed and before an atmosphere outside the furnace begins to flow into the furnace, and decreases the opening degree of the transforming gas flow regulating valve when a furnace pressure reaches a predetermined pressure after the opening of the furnace is closed, and in which the second regulator stops the feedback control at any one of before an opening of the furnace is opened, while the opening of the furnace is open, and after the opening of the furnace is closed and before an atmosphere outside the furnace begins to flow into the furnace, and resumes the feedback control when a furnace pressure reaches a predetermined pressure after the opening of the furnace is closed.

Further, according to the present invention, a heat treatment apparatus for supplying transforming gas and enriched gas inside a furnace and heat treating a workpiece inside the furnace is provided, which includes: a first transforming gas supply path and a second transforming gas supply path for supplying the transforming gas inside the furnace; a first regulator for regulating opening/closing of an open/close valve provided on the second transforming gas supply path and a second regulator for regulating an opening degree of an enriched gas flow regulating valve provided on a supply path of the enriched gas; and a feedback control system including the second regulator for feedback controlling carbon potential, in which the first regulator opens the open/close valve at any one of before an opening of the furnace is opened, while the opening of the furnace is open, and after the opening of the furnace is closed and before an atmosphere outside the furnace begins to flow into the furnace, and closes the open/close valve when a furnace pressure reaches a predetermined pressure after the opening of the furnace is closed, and in which the second regulator stops the feedback control at any one of before an opening of the furnace is opened, while the opening of the furnace is open, and after the opening of the furnace is closed and before an atmosphere outside the furnace begins to flow into the furnace, and resumes the feedback control when a furnace pressure reaches a predetermined pressure after the opening of the furnace is closed.

In this heat treatment apparatus, the second regulator may increase the opening degree of the enriched gas flow regulating valve when the feedback control is stopped. Further, the heat treatment apparatus may further include: a second enriched gas supply path for supplying the enriched gas inside the furnace, in which the second regulator may close an open/close valve provided on the second enriched gas supply path while the feedback control is performed, and open the open/close valve provided on the second enriched gas supply path when the feedback control is stopped.

The opening may be a carry-out port for carrying out a workpiece from the furnace, and an oil tank chamber may be provided outside the carry-out port of the furnace. Also, the heat treatment apparatus may further include a passing port for passing a workpiece provided between a carburizing chamber and a diffusing chamber provided inside the furnace; and a shutter for closing the passing port. Accordingly, atmospheres in the carburizing chamber and the diffusing chamber can be stabilized further.

Precisely, the present invention is for preventing disturbance of CP occurring when the opening of the furnace is opened or closed, and preventing a conventional phenomenon such that CP decreases due to sucking in air or the like by a negative pressure generated inside the furnace when the opening is opened or closed, by increasing the supply flow rate of the transforming gas or both the supply flow rate of the transforming gas and the supply flow rate of the enriched gas according to the opening or closing of the opening. By stabilizing CP, efficiency of heat treatment such as carburization for example is improved. Furthermore, in the case of carburization treatment, it is also possible to perform carburization treatment with high efficiency by providing a shutter between the carburizing chamber and the diffusing chamber, and keeping CP appropriately inside the diffusing chamber while maintaining high CP in the carburizing chamber.

BRIEF DESCRIPTION OF THE DRAWINGS

FIG. 15 is a chart showing ECD in a workpiece subjected to treatment of the experiment 1, a workpiece subjected to treatment of the comparative experiment 1, and a workpiece subjected to treatment of the comparative experiment 2.

DETAILED DESCRIPTION OF THE PREFERRED EMBODIMENT

Figure 1:
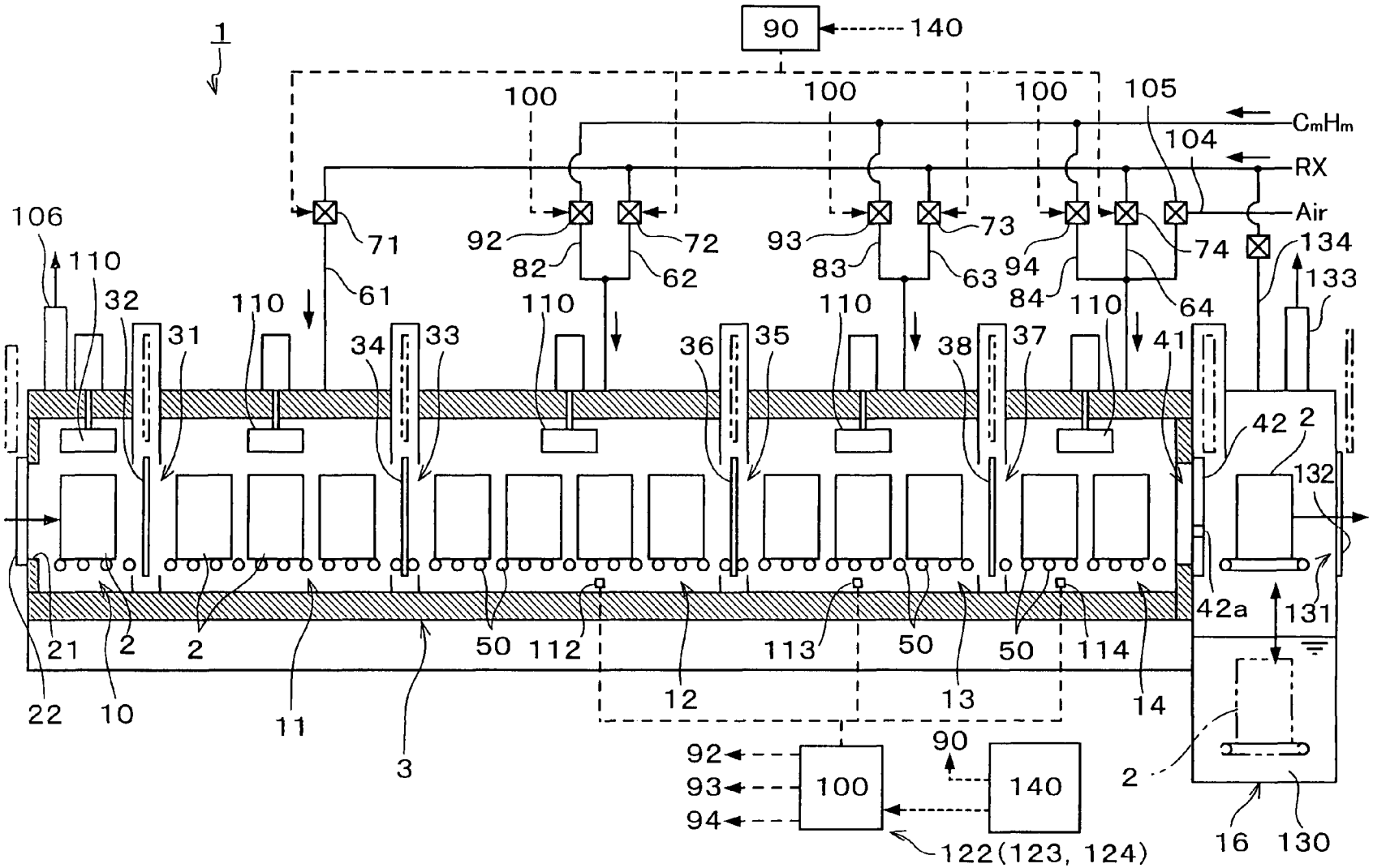
FIG. 1 is a schematic cross-sectional view describing the structure of a carburization treatment apparatus.

Hereinafter, a preferred embodiment of the present invention will be described with reference to the drawings. As shown in FIG. 1, a carburization treatment apparatus 1 as a heat treatment apparatus which implements a carburization treatment method as a heat treatment method according to the present invention has a heat treatment furnace 3 for performing heat treatment on a workpiece 2 that is a steel product. Inside the heat treatment furnace 3, a degreasing chamber 10 as a carry-in chamber, a preheating chamber 11, a carburizing chamber 12, a diffusing chamber 13, and a quenching chamber 14 are provided in this order from a front side toward a rear side (from the left to the right in FIG. 1). Behind the heat treatment furnace 3, an oil tank chamber 16 is provided.

At a front part of the heat treatment furnace 3, a carry-in port 21 is provided as an opening for carrying a workpiece 2 into the degreasing chamber 10 inside the heat treatment furnace 3, and a door 22 for opening/closing the carry-in port 21 is provided.

Between the degreasing chamber 10 and the preheating chamber 11, a passing port 31 for passing a workpiece 2 is formed, and a shutter 32 for shutting the passing port 31 is provided. Between the preheating chamber 11 and the carburizing chamber 12, a passing port 33 for passing a workpiece 2 is formed, and a shutter 34 for shutting the passing port 33 is provided. Between the carburizing chamber 12 and the diffusing chamber 13, a passing port 35 for passing a workpiece 2 is formed, and a shutter 36 for shutting the passing port 35 is provided. Between the diffusing chamber 13 and the quenching chamber 14, a passing port 37 for passing a workpiece 2 is formed, and a shutter 38 for shutting the passing port 37 is provided. When treating a workpiece 2 in the degreasing chamber 10, the preheating chamber 11, the carburizing chamber 12, the diffusing chamber 13, and the quenching chamber 14, the passing ports 31, 33, 35, and 37 can be shut by the shutters 32, 34, 36, and 38 respectively. It should be noted that when the passing ports 31, 33, 35, and 37 are shut by the shutters 32, 34, 36, and 38, atmospheres in the degreasing chamber 10, the preheating chamber 11, the carburizing chamber 12, the diffusing chamber 13, and the quenching chamber 14 are communicable with each other via gaps between the passing ports 31, 33, 35, 37 and the respective shutters 32, 34, 36, and 38.

At a rear part of the heat treatment furnace 3, a carry-out port 41 as an opening for carrying out a workpiece 2 from the heat treatment furnace 3 and carrying it into the oil tank chamber 16 is formed, and a door 42 for opening/closing the carry-out port 41 is provided. The aforementioned oil tank chamber 16 is provided outside the carry-out port 41 and is communicable with the heat treatment furnace 3 via the carry-out port 41. In the door 42, a hole **42*a*** is provided.

At a lower part of the heat treatment furnace 3, a roller conveyor 50 for carrying a workpiece 2 from the carry-in port 21 toward the carry-out port 41 side is provided. The workpiece 2 is carried by the roller conveyor 50 to pass through the passing ports 31, 33, 35, and 37 sequentially and is carried into and out of the degreasing chamber 10, the preheating chamber 11, the carburizing chamber 12, the diffusing chamber 13, and the quenching chamber 14 sequentially. It should be noted that plural workpieces 2 can be carried in a line in a carrying direction of the roller conveyor 50 into the preheating chamber 11, the carburizing chamber 12, the diffusing chamber 13, and the quenching chamber 14.

To the preheating chamber 11, the carburizing chamber 12, the diffusing chamber 13, and the quenching chamber 14, transforming gas supply paths 61, 62, 63, and 64 are connected respectively for supplying transforming gas (RX gas). The transforming gas is mainly constituted of CO (carbon monoxide) gas, $H_2$ (hydrogen) gas, and $N_2$ (nitrogen) gas, and includes a minute amount of $CO_2$ (carbon dioxide) and $H_2O$ (water). On the transforming gas supply paths 61, 62, 63, and 64, transforming gas flow regulating valves 71, 72, 73, and 74 are provided respectively. Opening degrees of the transforming gas flow regulating valves 71, 72, 73, and 74 are regulated by an output signal from a first regulator 90.

Further, to the carburizing chamber 12, the diffusing chamber 13, and the quenching chamber 14, enriched gas supply paths 82, 83, and 84 for supplying utility gas (city gas) or the like for example as enriched gas ($C_mH_n$ gas) are connected respectively. On the enriched gas supply paths 82, 83, and 84, enriched gas flow regulating valves 92, 93, and 94 are provided respectively. Opening degrees of the enriched gas flow regulating valves 92, 93, and 94 are regulated by an output signal from a second regulator 100.

Furthermore, to the quenching chamber 14, an air supply path 104 for supplying air is connected. On the air supply path 104, an air flow regulating valve 105 is provided. At an upper part of the degreasing chamber 10, an excess 106 for exhausting air is provided. At upper parts of the degreasing chamber 10, the preheating chamber 11, the carburizing chamber 12, the diffusing chamber 13, and the quenching chamber 14, fans 110 for stirring an atmosphere in each chamber are provided respectively, and moreover, although not being shown, heaters for heating an atmosphere in each chamber are provided respectively. Also, in the carburizing chamber 12, the diffusing chamber 13, and the quenching chamber 14, oxygen ($O_2$) sensors 112, 113, and 114 for measuring CP in each chamber are provided respectively. It is arranged that detected values of the respective oxygen sensors 112, 113, and 114 are transferred to the second regulator 100.

The regulator 100 has a function to calculate CP in each of the carburizing chamber 12, the diffusing chamber 13, and the quenching chamber 14 based on detected values of the oxygen sensors 112, 113, and 114, and also has a function of a PID (proportional-integral-differential) regulating meter to regulate an opening degree of each of the enriched gas flow regulating valves 92, 93, and 94 based on CP in each of the carburizing chamber 12, the diffusing chamber 13, and the quenching chamber 14. Specifically, the regulator 100 compares CP in each of the carburizing chamber 12, the diffusing chamber 13, and the quenching chamber 14 obtained by calculation with a target value thereof, obtains an operation amount for each of the enriched gas flow regulating valves 92, 93, and 94 to make each CP become the target value, and sends operation signals to the enriched gas flow regulating valves 92, 93, and 94. Then, in response to the operation signals from the regulator 100, opening degrees of the enriched gas supply flow regulating valves 92, 93, and 94 are regulated respectively, thereby regulating enriched gas supply flow rates from the enriched gas supply paths 82, 83, and 84 respectively. Namely, there are arranged a PID control system 122 as a feed back control system having the oxygen sensor 112, the regulator 100 and the enriched gas flow regulating valve 92, a PID control system 123 as a feed back control system having the oxygen sensor 113, the regulator 100 and the enriched gas flow regulating valve 93, and a PID control system 124 as a feed back control system having the oxygen sensor 114, the regulator 100 and the enriched gas flow regulating valve 94. CP in the carburizing chamber 12 is controlled by the PID control system 122, CP in the diffusing chamber 13 is controlled by the PID control system 123, and CP in the quenching chamber 14 is controlled by the PID control system 124.

At a lower part of the oil tank chamber 16, an oil tank 130 is provided. Also, an exit 131 for carrying out a workpiece 2 from the oil tank chamber 16 is formed, and a door 132 for opening/closing the exit 131 is provided. Further, on an upper part of the oil tank chamber 16, an excess 133 for exhausting air and a transforming gas supply path 134 for supplying transforming gas to the oil tank chamber 16 are attached.

It should be noted that the atmosphere inside the heat treatment furnace 3 is exhausted via the excess 106, flows into the oil tank chamber 16 via the hole 42*a* of the door 42 and is exhausted via the excess 133. Further, as described above, when the passing ports 31, 33, 35 and 37 are shut by the shutters 32, 34, 36, and 38 respectively, atmospheres in the degreasing chamber 10, the preheating chamber 11, the carburizing chamber 12, the diffusing chamber 13, and the quenching chamber 14 are communicable with each other, and during heat treatment of a workpiece 2, the atmosphere in the heat treatment furnace 3 flows generally from the diffusing chamber 13 through the carburizing chamber 12, the preheating chamber 11, and the degreasing chamber 10 sequentially to be exhausted via the excess 106. Also, it flows from the diffusing chamber 13 to the quenching chamber 14, flows into the oil tank chamber 16 via the hole 42*a* of the door 42, and is exhausted via the excess 133. In this way, atmospheres in the degreasing chamber 10, the preheating chamber 11, the carburizing chamber 12, the diffusing chamber 13, and the quenching chamber 14 are regulated preferably. Particularly, when the shutter 36 is provided between the diffusing chamber 13 and the carburizing chamber 12, it is possible to prevent flow of an atmosphere from the diffusing chamber 13 into the carburizing chamber 12, thereby preventing increase of CP in the diffusing chamber 13. Also, a furnace pressure inside the heat treatment furnace 3 can be controlled by regulating opening degrees of the excesses 106 and 133.

Also, in the carburization treatment apparatus 1, a sequencer 140 for controlling processes in the carburization treatment apparatus 1 is provided. The aforementioned regulator 90 and 100 are connected to the sequencer 140 via a network or the like.

Next, carburizing treatment processes of a workpiece 2 using the carburization treatment apparatus 1 constructed as above will be explained. First, the carry-in port 21 of the heat treatment furnace 3 is opened, a workpiece 2 is carried into the degreasing chamber 10, the carry-in port 21 is closed, and degreasing treatment is performed. In the degreasing chamber 10, the workpiece 2 is heated to approximately 80° C. Next, the passing port 31 is opened, the workpiece 2 is moved from the degreasing chamber 10 to the preheating chamber 11, and the passing port 31 is closed. In the preheating chamber 11, the workpiece 2 is heated to approximately 940° C. After the preheating, the passing port 33 is opened, the workpiece 2 is moved from the preheating chamber 11 to the carburizing chamber 12, and the passing port 33 is closed. In the carburizing chamber 12, the workpiece 2 is heated to approximately 950° C. and carburization treatment is performed for a predetermined period of time. Cp in the carburizing chamber 12 is maintained at a relatively high value, approximately 1.1% for example, by PID control. After the carburization treatment, the passing port 35 is opened, the workpiece 2 is moved from the carburizing chamber 12 to the diffusing chamber 13, and the passing port 35 is closed. In the diffusing chamber 13, the workpiece 2 is heated to approximately 950° C., and diffusion treatment is performed for a predetermined period of time. Cp in the diffusing chamber 13 is maintained at approximately 0.8% by PID control. After the diffusion, the passing port 37 is opened, the workpiece 2 is moved from the diffusing chamber 13 to the quenching chamber 14, and the passing port 37 is closed. In the quenching chamber 14, the workpiece 2 is cooled down to approximately 850° C., and quenching is performed for a predetermined period of time. CP in the quenching chamber 14 is maintained at approximately 0.7% by PID control. After the quenching, the carry-out port 41 of the heat treatment furnace 3 is opened, the workpiece 2 is carried into the oil tank chamber 16, and the carry-out port 41 is closed. Then, in the oil tank chamber 16, the workpiece 2 is dipped in the oil tank 130 to perform oil quenching and then pulled out of the oil tank 130, and thereafter the exit 131 is opened to carry out the workpiece 2. As described above, a series of treatment in the carburization treatment apparatus 1 is completed.

Figure 2:
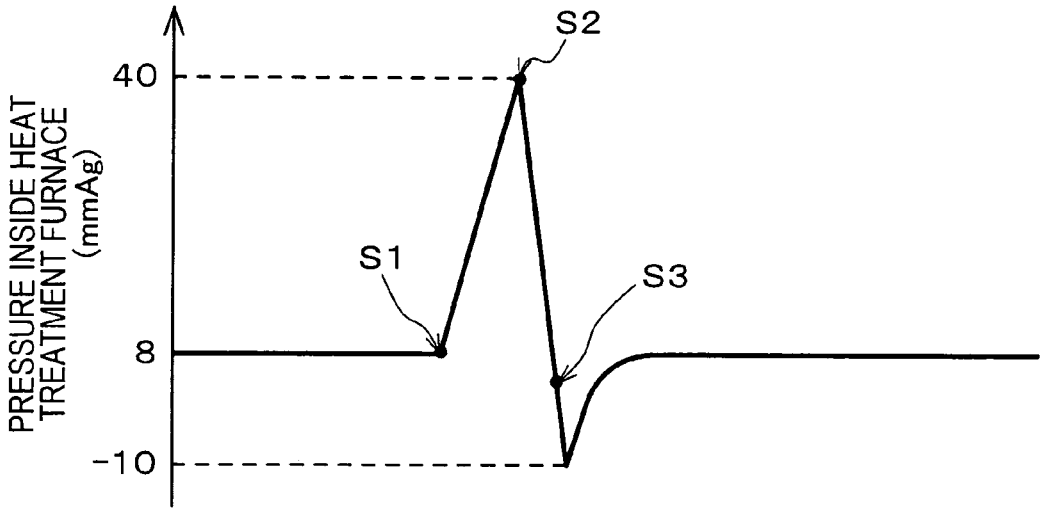
FIG. 2 is a graph describing a change of a pressure inside a heat treatment furnace.
Figure 3:
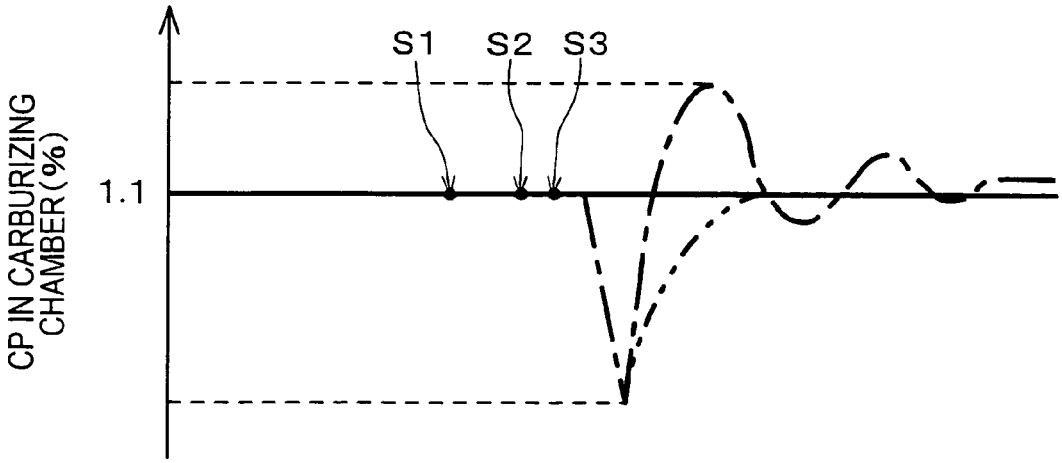
FIG. 3 is a graph describing a change of CP inside a carburizing chamber.
Figure 4:
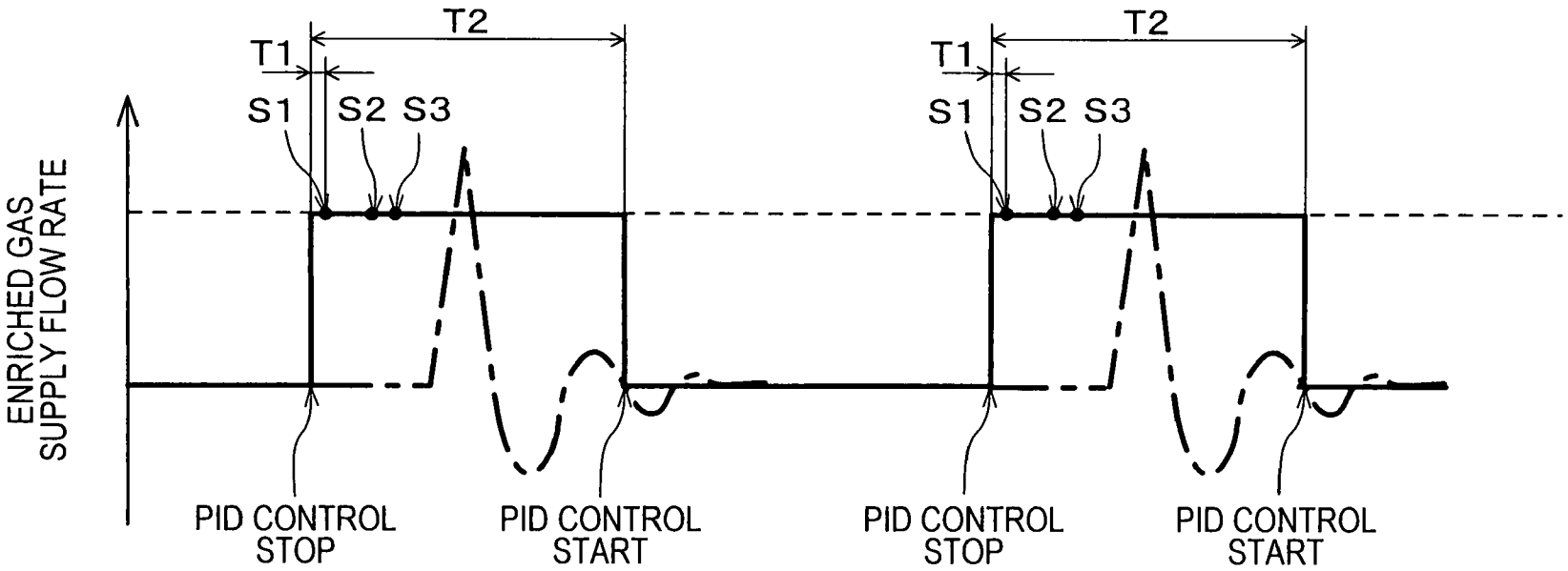
FIG. 4 is a graph describing a change of a supply flow rate of enriched gas to the carburizing chamber.

Incidentally, when the carry-in port 21 and the exit 131 of the oil tank chamber 16 are both closed while opening/closing the carry-out port 41 of the heat treatment furnace 3, continuing the PID control of CP values can cause a problem of inefficiency in control of CP values. FIG. 2 shows a change of a pressure inside the heat treatment furnace 3 when the carry-out port 41 is opened with the carry-in port 21 and the exit 131 being closed. FIG. 3 and FIG. 4 show a change of CP in the carburizing chamber 12 and a change of a supply flow rate of enriched gas from the enriched gas supply path 82 at this time, respectively. With the carry-in port 21 and the exit 131 of the oil tank chamber 16 being closed, when the carry-out port 41 of the heat treatment furnace 3 starts to open (S1 in FIG. 2), an atmosphere having a low temperature in the oil tank chamber 16 is heated up by radiant heat from the inside of the heat treatment furnace 3 and expands rapidly, thereby increasing the pressure inside the heat treatment furnace 3 as shown in FIG. 2. Thereafter, when the carry-out port 41 starts to close (S2 in FIG. 2), the pressure in the heat treatment furnace 3 drops rapidly. When the carry-out port 41 is closed (S3 in FIG. 2), the pressure in the heat treatment furnace 3 continues to drop, and thereafter air is sucked in from the outside of the heat treatment furnace 3. Accordingly, as shown by a chain dashed line in FIG. 3, CP in the carburizing chamber 12 drops rapidly. When the PID control of the PID control system 122 is continued as it is while the CP thus drops rapidly, the enriched gas supply flow rate from the enriched gas supply path 82 is controlled to rise rapidly as shown by a chain dashed line in FIG. 4, and the CP in the carburizing chamber 12 overshoots as shown by the chain dashed line in FIG. 3. Then, a problem occurs such as making the CP unstable to cause hunting, or taking a long time to reach a target value, or the like, and thus the control cannot be done favorably. Accordingly, in this embodiment, the PID control of the PID control system 122 is stopped when the carry-out port 41 is opened/closed so as to prevent the CP from becoming unstable. In this way, as shown by a double chain dashed line in FIG. 3, even when the CP in the carburizing chamber 12 decreases, the CP can be made close to the target value stably. Furthermore, in this embodiment, in addition to stopping the PID control, by increasing the transforming gas supply flow rate from the transforming gas supply path 62 and the enriched gas supply flow rate from the enriched gas supply path 82, decrease in pressure inside the carburizing chamber 12 and decrease in CP inside the carburizing chamber 12 are prevented. For the same reason, in the diffusing chamber 13 and the quenching chamber 14, the PID control in the PID control systems 123 and 124 are stopped when the carry-out port 41 is opened/closed, and moreover, the transforming gas supply flow rates from the transforming gas supply paths 63 and 64 and the enriched gas supply flow rates from the enriched gas supply paths 83, 84 are increased.

Figure 5:
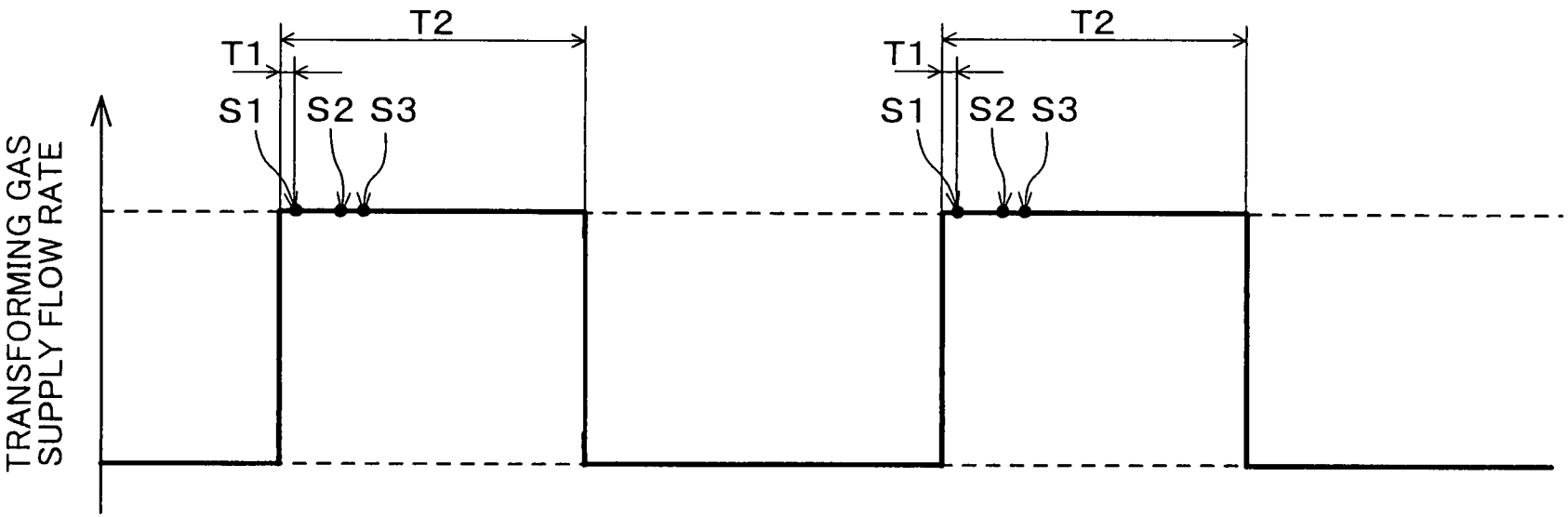
FIG. 5 is a graph describing a change of a supply flow rate of transforming gas to the carburizing chamber.

To describe specifically, first, before the carry-out port 41 is opened, the enriched gas supply flow rates from the enriched gas supply paths 82, 83, and 84 are regulated by the PID control systems 122, 123, and 124 respectively, and the transforming gas supply flow rates from the transforming gas supply paths 62, 63, and 64 are maintained at a constant flow rate respectively by maintaining opening degrees of the transforming gas flow regulating valves 72, 73, and 74 constantly as shown in FIG. 5. Then, immediately before the carry-out port 41 is opened, an instruction is given from the sequencer 140 to the regulator 100 to stop the PID control and increase the opening degrees of the enriched gas flow regulating valves 92, 93, and 94, and then as shown by a solid line in FIG. 4, the supply flow rates from the enriched gas supply paths 82, 83, and 84 are increased to a predetermined value. Also, an instruction is given from the sequencer 140 to the regulator 100 to increase the opening degrees of the transforming gas flow regulating valves 72, 73, and 74, and then as shown by a solid line in FIG. 5, the supply flow rates from the transforming gas supply paths 62, 63, and 64 are increased to a predetermined value respectively. After a predetermined time T1 has passed since the PID control is thus stopped and the supply flow rates of the enriched gas and the transforming gas are increased from the supply flow rates of immediately before the PID control is stopped, an instruction to open the carry-out port 41 is given from the sequencer 140 to a not-shown opening/closing drive mechanism of the door 42. Thereafter, after a predetermined time T2 has passed since the PID control is stopped, an instruction to resume the PID control is given from the sequencer 140 to the regulator 100. Thus, the opening degrees of the enriched gas flow regulating valves 92, 93, and 94 become close to the state before the PID control is stopped, and as shown by the solid line in FIG. 4, the enriched gas supply flow rates from the enriched gas supply paths 82, 83, and 84 respectively decrease to be close to the state before the PID control is stopped. Also, an instruction to decrease the opening degrees of the transforming gas flow regulating valves 72, 73, and 74 is given from the sequencer 140 to the regulator 90, and as shown in FIG. 5, the supply flow rates of the transforming gas supply paths 62, 63, and 64 return respectively to the state before the PID control is stopped. By the above method, the CP can be maintained approximately constantly as shown by a solid line in FIG. 3.

It should be noted that the predetermined time T2 may be determined in advance so as to assure a sufficient time based on experiments. For example, an average time may be determined from passing of the predetermined time T1 after the PID control is stopped and the supply flow rates of the enriched gas and the transforming gas are increased, through opening of the carry-out port 41, carrying out of the workpiece 2, closing of the carry-out port 41, until approximating thereafter of the furnace pressure in the heat treatment furnace 3 to a predetermined pressure, for example a furnace pressure before the carry-out port 41 is opened, so as to adopt the required time thereof as the predetermined time T2. Specifically, it may be set such that, after the carry-out port 41 is closed and the furnace pressure returns to a predetermined pressure, for example a furnace pressure before the carry-out port 41 is opened, the PID control is resumed and the opening degrees of the transforming gas flow regulating valves 72, 73, and 74 are set back. Thus, after the furnace pressure increases sufficiently and thus there is no more suction of air, the PID control can be resumed and also the supply flow rates of the transforming gas can be set back. Even when the PID control is resumed, the CP can be prevented from becoming unstable, and by increasing the supply flow rate of the transforming gas while air is sucked into the furnace, decrease in CP can be securely prevented.

According to such a carburization treatment apparatus 1, by increasing the supply flow rates of the transforming gas and the enriched gas when opening the carry-out port 41 of the heat treatment furnace 3, decrease of the furnace pressure inside the heat treatment furnace 3 can be prevented, and moreover, entrance of air into the heat treatment furnace 3 and decrease of CP inside the heat treatment furnace 3 can be prevented. By stopping the feedback control of CP when the carry-out port 41 of the heat treatment furnace 3 is opened, the CP can be prevented from becoming unstable. Stabilization of CP can be achieved easily without performing complex control setting. By stabilizing CP in the heat treatment furnace 3, carburization treatment can be performed effectively. For example, during treatment of a workpiece 2 in the degreasing chamber 10, the preheating chamber 11, the carburizing chamber 12, the diffusing chamber 13 or the quenching chamber 14, when the carry-out port 41 is opened and another workpiece 2 is moved from the quenching chamber 14 to the oil tank chamber 16, variation of CP in each of the degreasing chamber 10, the preheating chamber 11, the carburizing chamber 12, the diffusing chamber 13, and the quenching chamber 14 can be suppressed. Therefore, respective treatment in the degreasing chamber 10, the preheating chamber 11, the carburizing chamber 12, the diffusing chamber 13, and the quenching chamber 14 can be performed favorably. Moreover, improvement in reliability of treatment effects and reduction in treating time can be achieved.

As above, the preferred embodiment of the present invention has been explained, but the present invention is not limited to such an example. It will be clear for those skilled in the art that various types of variation examples and modification examples may be devised within the range of the technical ideas described in the appended claims, and it will be understood that such examples belong to the technical scope of the present invention as a matter of course.

In the above embodiment, the method is explained in which the supply flow rates of the transforming gas and the enriched gas are increased simultaneously and decreased after the same predetermined time T2, but the timing to increase or decrease the supply flow rates of the transforming gas and the enriched gas is not limited to this. For example, a time T3 to increase the enriched gas supply flow rate may be set shorter than the time T2 to increase the transforming gas supply flow rate. An increase start time of the supply flow rate of the transforming gas and an increase start time of the supply flow rate of the enriched gas may be different from each other.

Also, in the above embodiment, operations such as stopping the PID control, starting of increasing the supply flow rate of the transforming gas, starting of increasing the supply flow rate of the enriched gas, and so on are performed immediately before the carry-out port 41 is opened, but these operations may be performed after the carry-out port 41 is opened, instead of before the carry-out port 41 is opened. Specifically, when these operations are performed after the carry-out port 41 is closed and before an atmosphere outside the furnace begins to flow into the heat treatment furnace 3, it is possible to prevent decrease or disturbance of CP. For example, the above-described operations may be performed while the carry-out port 41 is open. Also, with an average time from closing of the carry-out port 41 to starting of flow of an atmosphere outside the furnace into the heat treatment furnace 3 being determined in advance, the above-described operations may be performed before this time passes. Also, the above-described operations may be performed after the carry-out port 41 is closed and before the furnace pressure inside the heat treatment furnace 3 decreases to a predetermined value.

Also, in the above embodiment, the supply flow rates of the transforming gas and the enriched gas are increased together, but only the supply flow rate of the transforming gas may be increased while keeping the supply flow rate of the enriched gas at the supply flow rate of immediately before the PID control is stopped. Specifically, only by stopping the PID control and increasing the supply flow rate of the transforming gas, decrease of CP accompanying opening/closing of the carry-out port 41 can be prevented sufficiently.

In the above-described embodiment, the supply flow rates of the transforming gas and the enriched gas are regulated by regulating the opening degrees of the transforming gas flow regulating valves 72, 73, and 74 and the opening degrees of the enriched gas flow regulating valves 92, 93, and 94 respectively, but with second transforming gas supply paths for supplying the transforming gas being provided in the carburizing chamber 12, the diffusing chamber 13, and the quenching chamber 14 respectively for example, the transforming gas supply flow rate may be increased by supplying the transforming gas from the second transforming gas supply paths only when the carry-out port 41 is opened. Similarly, with second enriched gas supply paths for supplying the enriched gas being provided in the carburizing chamber 12, the diffusing chamber 13, and the quenching chamber 14 respectively for example, the enriched gas supply flow rate may be increased by supplying the enriched gas from the second enriched gas supply paths only when the carry-out port 41 is opened.

Figure 6:
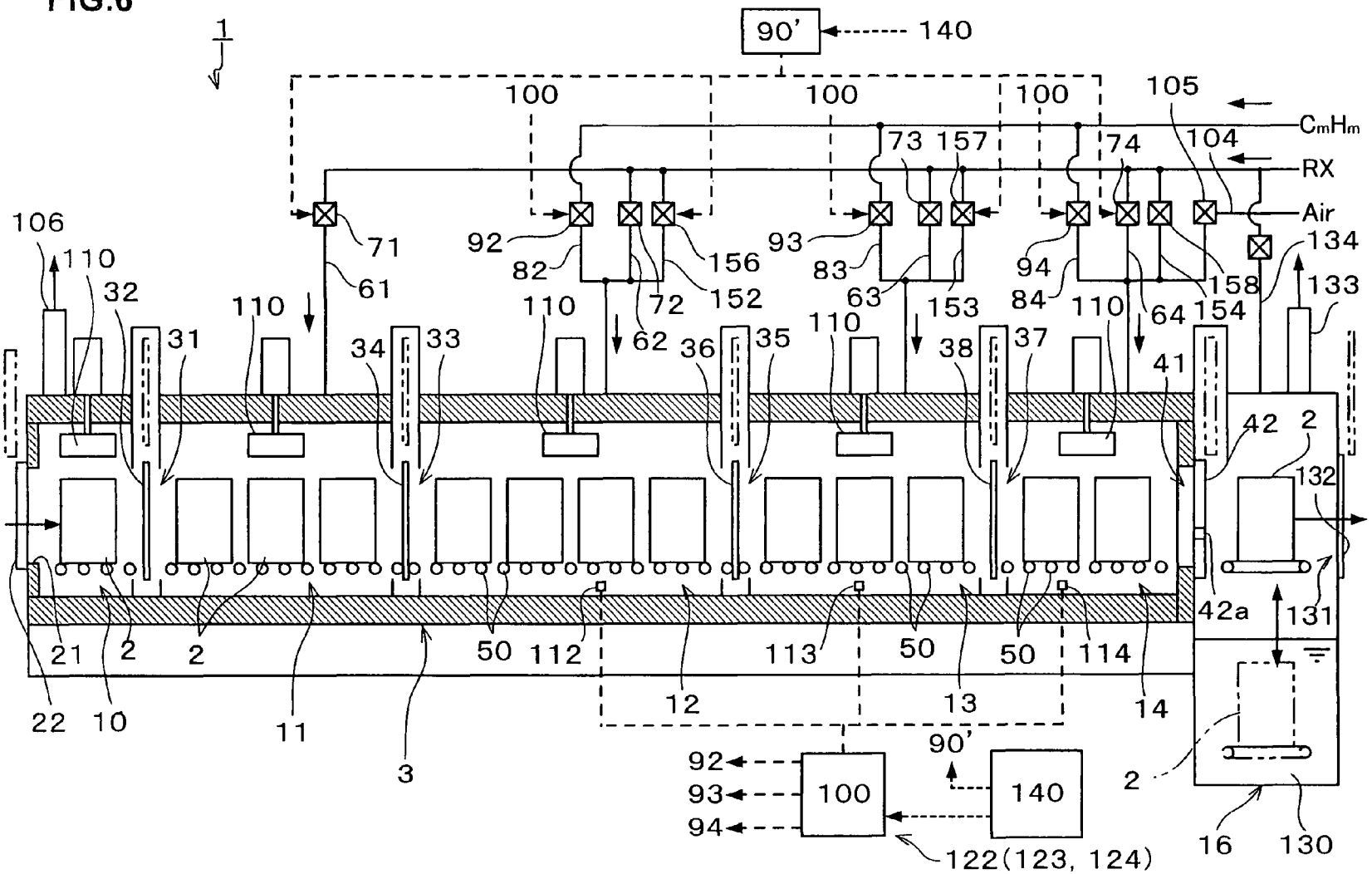
FIG. 6 is a schematic cross-sectional view describing the structure of a carburization treatment apparatus according to another embodiment.

For example, as shown in FIG. 6, other than the first transforming gas supply paths 62, 63, and 64, second transforming gas supply paths 152, 153, and 154 for increasing the transforming gas are connected to the carburizing chamber 12, the diffusing chamber 13, and the quenching chamber 14 respectively. In the shown example, the respective second transforming gas supply paths 152, 153, and 154 are bypass circuits provided between a supply source of the transforming gas and a downstream side of the transforming gas flow regulating valves 72, 73, and 74 of the transforming gas supply paths 62, 63, and 64. On the second transforming gas supply paths 152, 153, and 154, open/close valves 156, 157, and 158 are provided respectively. Open/close operations of the respective open/close valves 156, 157, and 158 are regulated by an output signal from the first regulator 90'. This first regulator 90' performs operations to open the open/close valves 156, 157, and 158 at any one of immediately before the carry-out port 41 is opened, while the carry-out port 41 is open, and after the carry-out port 41 is closed and before an atmosphere outside the furnace begins to flow into the heat treatment furnace 3, and close the open/close valves 156, 157, and 158 when the furnace pressure reaches a predetermined pressure after the carry-out port 41 is closed. In such an arrangement, in a normal state before the carry-out port 41 is opened, the respective open/close valves 156, 157, and 158 are closed and thus the transforming gas is not supplied from the second transforming gas supply paths 152, 153, and 154, but a constant flow amount of transforming gas is supplied from the first transforming gas supply paths 62, 63, and 64 respectively. Then, at any one of immediately before the carry-out port 41 is opened, while the carry-out port 41 is open, and after the carry-out port 41 is closed and before an atmosphere outside the furnace begins to flow into the heat treatment furnace 3, an instruction to open the respective open/close valves 156, 157, and 158 is given from the sequencer 140 to the first regulator 90'. Thus, the open/close valves 156, 157, and 158 are opened, and a constant flow amount of transforming gas is supplied from the second transforming gas supply paths 152, 153, and 154 to the carburizing chamber 12, the diffusing chamber 13, and the quenching chamber 14 respectively. In other words, it is a state that in addition to the constant flow amount of the transforming gas from the first transforming gas supply paths 62, 63, and 64, the constant flow amount of the transforming gas is supplied from the second transforming gas supply paths 152, 153, and 154, which increases the supply flow rate of the transforming gas to the carburizing chamber 12, the diffusing chamber 13, and the quenching chamber 14. Then, after the carry-out port 41 is closed and the furnace pressure inside the heat treatment furnace 3 becomes a predetermined pressure, an instruction to close the open/close valves 156, 157, and 158 is given from the sequencer 140 to the first regulator 90'. Thus, the open/close valves 156, 157, and 158 are closed again, thereby returning to the state of supplying the transforming gas only from the first transforming gas supply paths 62, 63, and 64. In other words, the supply flow rate of the transforming gas to the carburizing chamber 12, the diffusing chamber 13, and the quenching chamber 14 decreases and returns to the supply flow rate of immediately before the PID control is stopped. Also in this manner, the supply flow rate of the transforming gas to the carburizing chamber 12, the diffusing chamber 13, and the quenching chamber 14 can be controlled preferably, and thus decrease of CP accompanying opening/closing of the carry-out port 41 can be prevented preferably.

Figure 7:
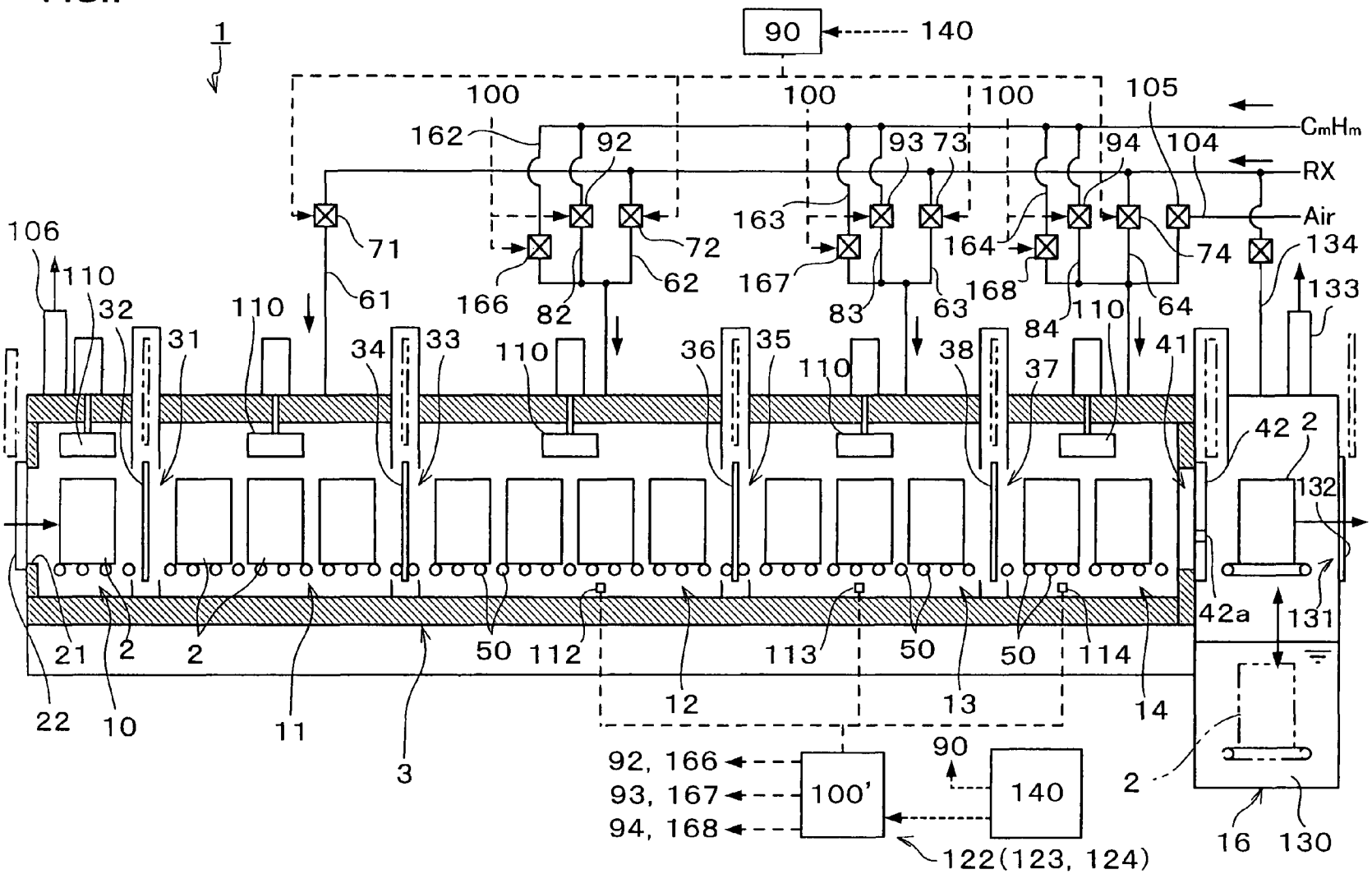
FIG. 7 is a schematic cross-sectional view describing the structure of a carburization treatment apparatus according to another embodiment.

Also, as shown in FIG. 7 for example, other than the first enriched gas supply paths 82, 83, and 84, second enriched gas supply paths 162, 163, and 164 for increasing the enriched gas are connected to the carburizing chamber 12, the diffusing chamber 13, and the quenching chamber 14 respectively. In the shown example, the respective second enriched gas supply paths 162, 163, and 164 are bypass circuits provided between a supply source of the enriched gas and a downstream side of the enriched gas flow regulating valves 92, 93, and 94 of the enriched gas supply paths 82, 83, and 84. On the second enriched gas supply paths 162, 163, and 164, open/close valves 166, 167, and 168 are provided respectively. Open/close operations of the respective open/close valves 166, 167, and 168 are regulated by an output signal from the second regulator 100'. This second regulator 100' performs operations to close the respective open/close valves 166, 167, and 168 when PID control is performed, and open the respective valves 166, 167, and 168 when the PID control is stopped. In such an arrangement, in a normal state before the carry-out port 41 is opened, the respective open/close valves 166, 167, and 168 are closed and thus the enriched gas is not supplied from the second enriched gas supply paths 162, 163, and 164, but the enriched gas is supplied from the first enriched gas supply paths 82, 83, and 84 respectively while being regulated based on the PID control. Then, at any one of immediately before the carry-out port 41 is opened, while the carry-out port 41 is open, and after the carry-out port 41 is closed and before an atmosphere outside the furnace begins to flow into the heat treatment furnace 3, an instruction to open the respective open/close valves 166, 167, and 168 is given from the sequencer 140 to the second regulator 100' together with an instruction to stop the PID control. Thus, the open/close valves 166, 167, and 168 are opened, and a constant flow amount of enriched gas is supplied from the second enriched gas supply paths 162, 163, and 164 to the carburizing chamber 12, the diffusing chamber 13, and the quenching chamber 14 respectively. In other words, it is a state that the supply flow rates from the first enriched gas supply paths 82, 83, and 84 are maintained at the supply flow rates of immediately before the PID control is stopped, and in addition to this enriched gas from the first enriched gas supply paths 82, 83, and 84, the constant flow amount of the enriched gas is supplied from the second enriched gas supply paths 162, 163, and 164, which increases the supply flow rate of the enriched gas to the carburizing chamber 12, the diffusing chamber 13, and the quenching chamber 14. Then, after the carry-out port 41 is closed and the furnace pressure inside the heat treatment furnace 3 becomes a predetermined pressure, an instruction to close the open/close valves 166, 167, and 168 is given from the sequencer 140 to the first regulator 100' together with the instruction to resume the PID control. Thus, the open/close valves 166, 167, and 168 are closed again. In other words, it returns to a state that the supply flow rate of the enriched gas to the carburizing chamber 12, the diffusing chamber 13, and the quenching chamber 14 is decreased, and the enriched gas is supplied only from the first enriched gas supply paths 82, 83, and 84 while being regulated based on the PID control. Also in this manner, the supply flow rate of the enriched gas to the carburizing chamber 12, the diffusing chamber 13, and the quenching chamber 14 can be controlled preferably, and thus decrease of CP accompanying opening/closing of the carry-out port 41 can be prevented preferably.

In the above-described embodiment, the PID control is performed by the PID control systems 122, 123, and 124, but it may be arranged to control CP by any other feedback control. For example, the regulator 100 may be provided with a function of a PI (proportional-integral) regulating meter, where respective CP in the carburizing chamber 12, the diffusing chamber 13, and the quenching chamber 14 are each controlled by a PI control system as a feed back control system constituted of the oxygen sensor 112, 113, or 114, the regulator 100, and the enriched gas flow regulating valves 92, 93, or 94.

EXAMPLE

The inventors of the present invention performed the following experiment 1, comparative experiment 1, and comparative experiment 2 for verifying effects of the present invention. In all of the experiment 1, the comparative experiment 1, and the comparative experiment 2, a heat treatment furnace of batch type is used, a workpiece is inserted into the furnace, and atmospheres similar to those in the carburizing chamber, the diffusing chamber and the quenching chamber in the sequential type heat treatment furnace as shown in this embodiment are realized in order, thereby treating the workpiece. Then, carbon concentration distribution near the surface of the workpiece is measured after the treatment. Note that an SS400 round bar complying with the JIS standard is used as a dummy workpiece.

[Experiment 1]

Figure 8:
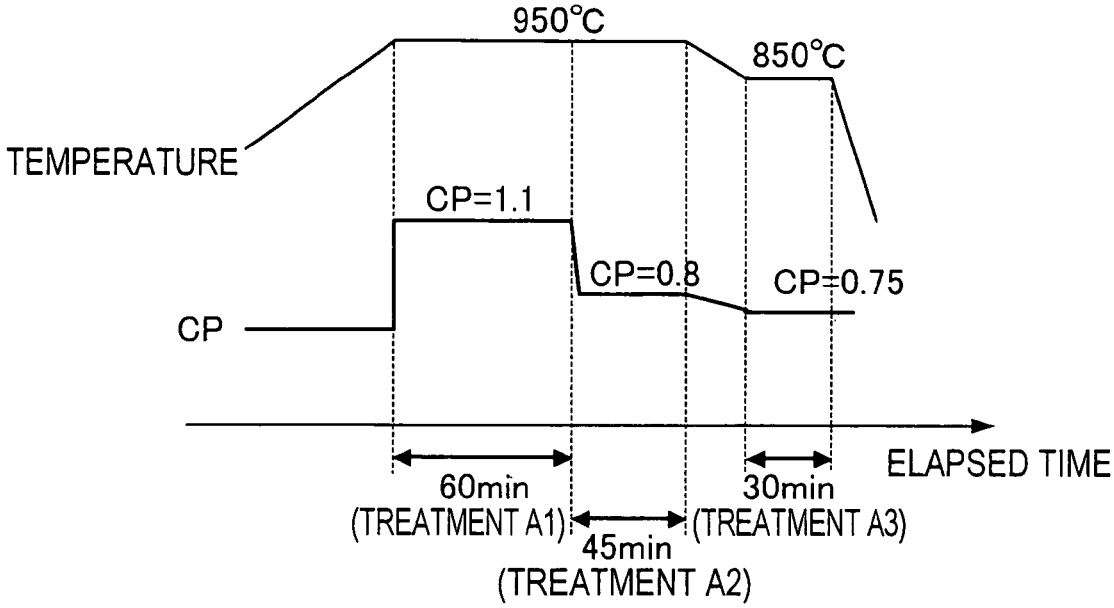
FIG. 8 is a graph showing variations of a target value of a furnace temperature and a target value of CP in experiment 1.

As an atmosphere similar to that in the carburizing chamber 12 of the heat treatment furnace 3, an atmosphere in which the target value of a furnace temperature is 950° C. and the target value of CP (a measured value by electromotive force value method (oxygen sensor method), the same used below) is 1.1% was maintained for approximately 60 minutes (refer to FIG. 8, treatment A1). Subsequently, as an atmosphere similar to that in the diffusing chamber 13, an atmosphere in which the target value of a furnace temperature is 950° C. and the target value of CP is 0.8% was maintained for approximately 45 minutes (treatment A2). Subsequently, as an atmosphere similar to that in the quenching chamber 14, an atmosphere in which the target value of a furnace temperature is 850° C. and the target value of CP is 0.75% was maintained for approximately 30 minutes (treatment A3). Note that the concentration of $CO_2$ in the transforming gas is 0.20%.

[Comparative Experiment 1]

Figure 9:
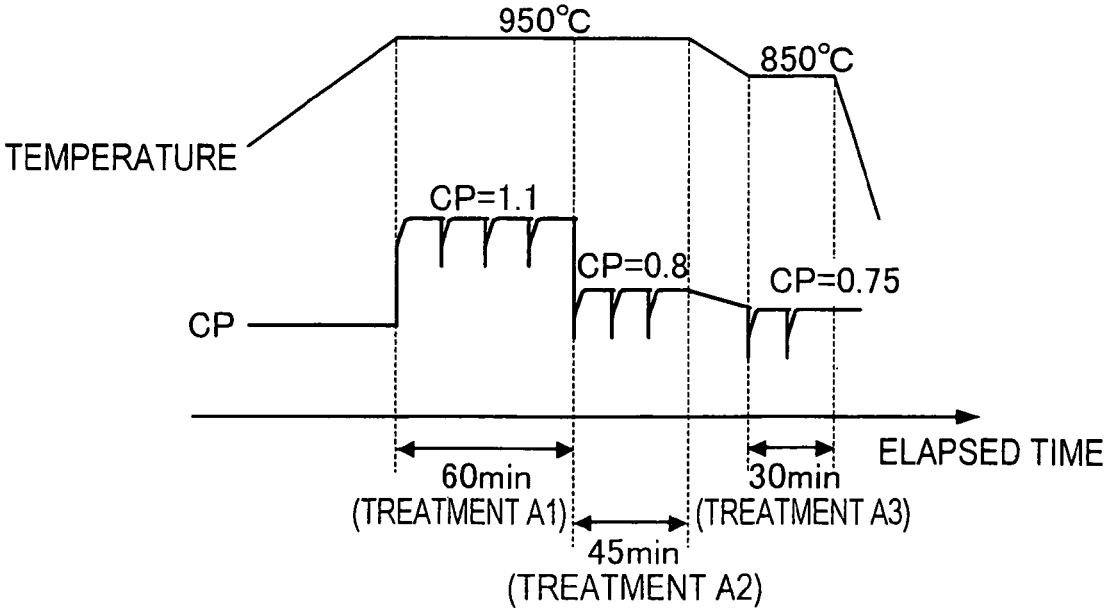
FIG. 9 is a graph showing variations of a target value of a furnace temperature and a target value of CP in comparative experiment 1.

In the comparative experiment 1, variation of the furnace temperature and the target value of CP is set similarly to the experiment 1, and further, as shown in FIG. 9, operations to decrease and return the CP intermittently are performed. Specifically, as treatment in a conventional sequential type heat treatment furnace, a phenomenon is recreated such that the CP decreases every time an opening is opened/closed for carrying in or out a workpiece. Decreasing CP is performed three times in the treatment A1 at predetermined time periods, twice in the treatment A2 at predetermined time periods, and twice in the treatment A3 at predetermined time periods. Note that the time between starting of decreasing CP and returning to the original CP is approximately seven minutes for each operation. Also, decreasing CP is realized by stopping supply of the enriched gas and introducing oxygen. The concentration of $CO_2$ in the transforming gas is 0.20% similarly to the experiment 1.

[Comparative Experiment 2]

Figure 10:
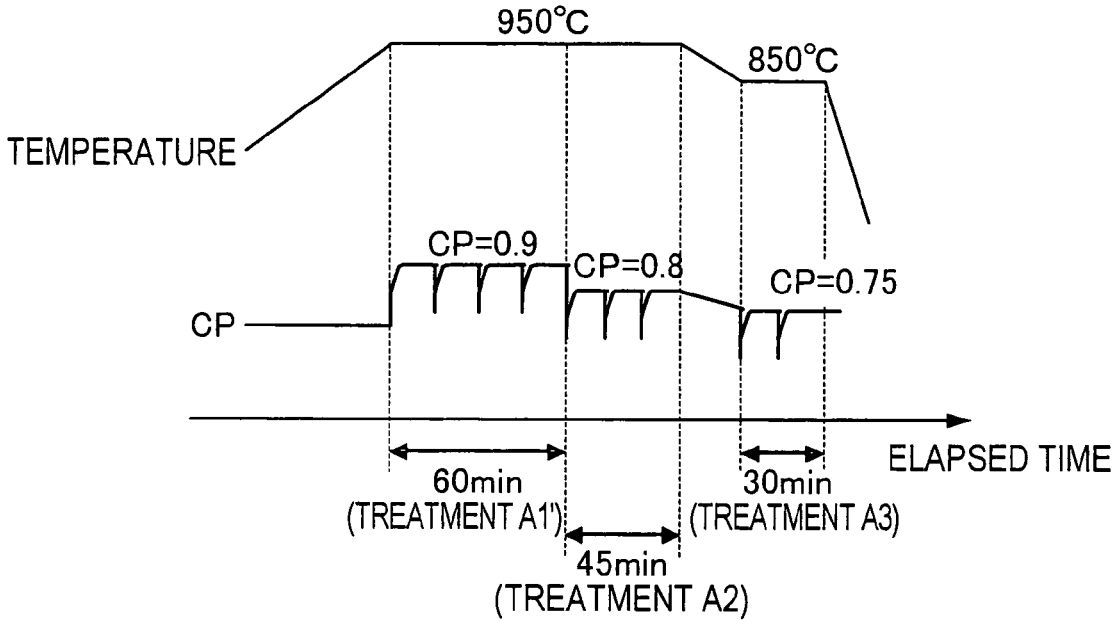
FIG. 10 is a graph showing variations of a target value of a furnace temperature and a target value of CP in comparative experiment 2.

In the comparative experiment 2, the target value of CP in the treatment A1 in the comparative experiment 1 is changed to 0.9% (refer to FIG. 10, treatment A1'). Further, the concentration of $CO_2$ in the transforming gas is changed to 0.40%. Other conditions are the same as in the comparative experiment 1.

[Experimental Results and Examination]

Figure 11:
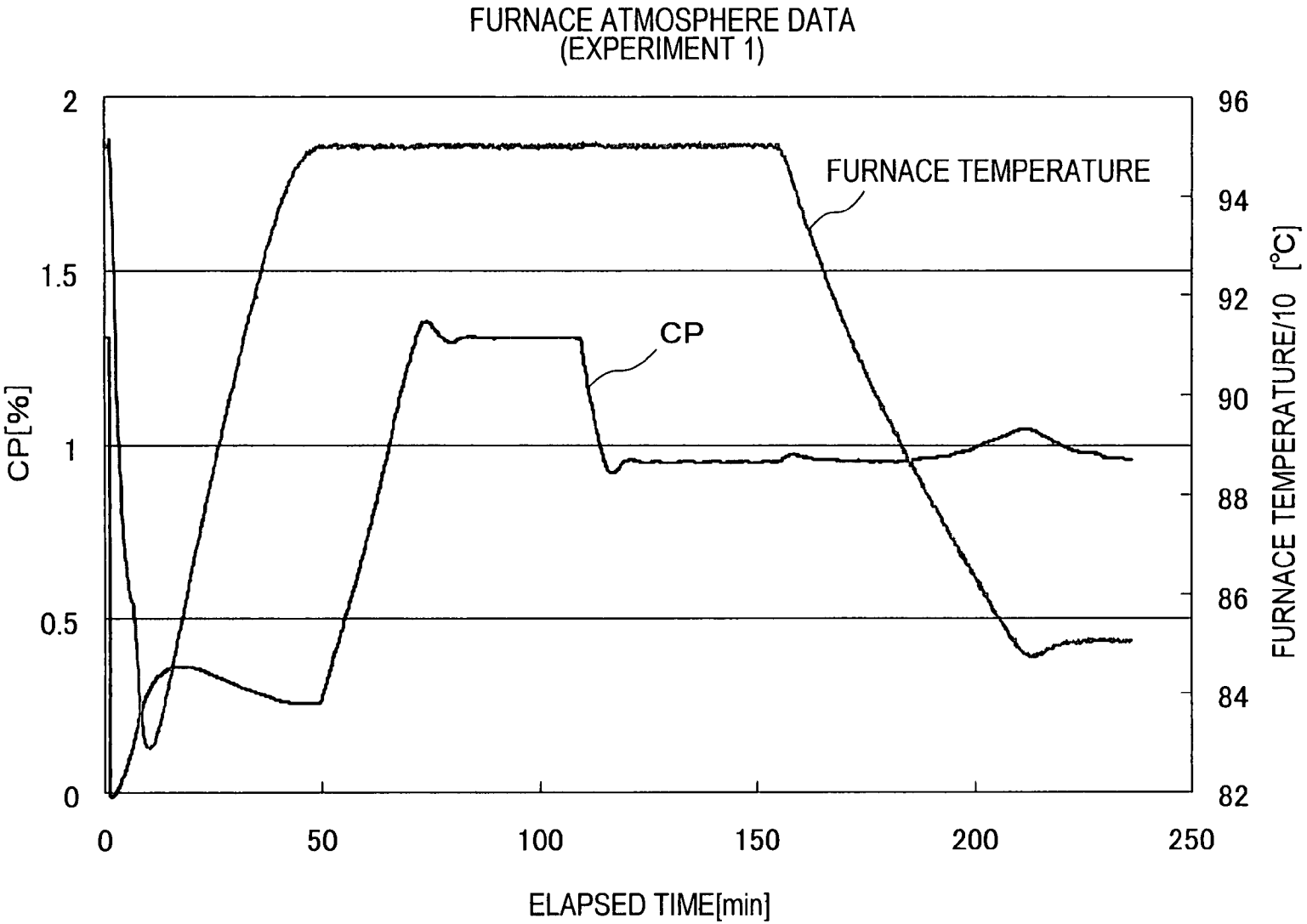
FIG. 11 is a graph showing variations of measured values of a furnace temperature and CP obtained in the experiment 1.
Figure 12:
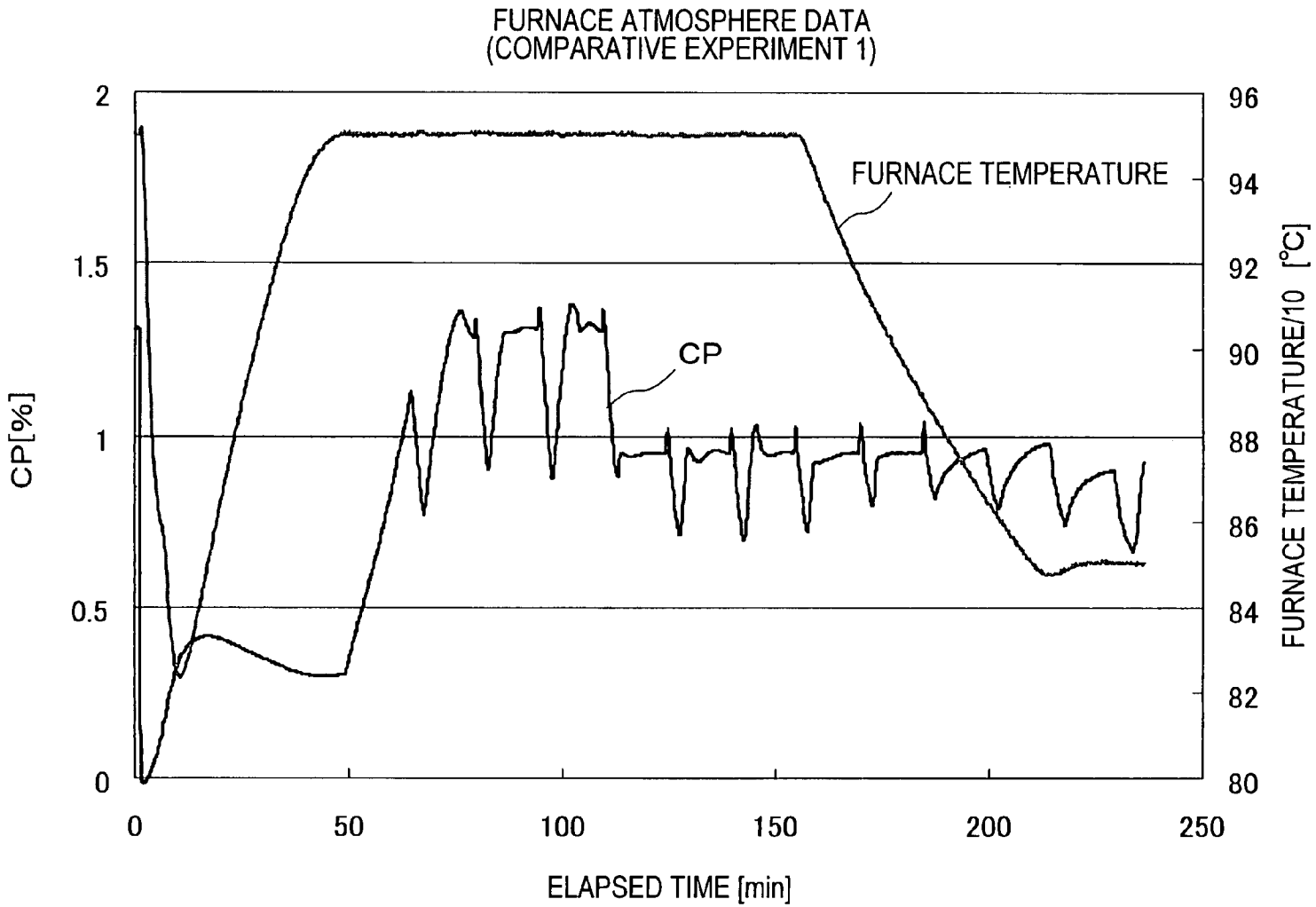
FIG. 12 is a graph showing variations of measured values of a furnace temperature and CP obtained in the comparative experiment 1.
Figure 13:
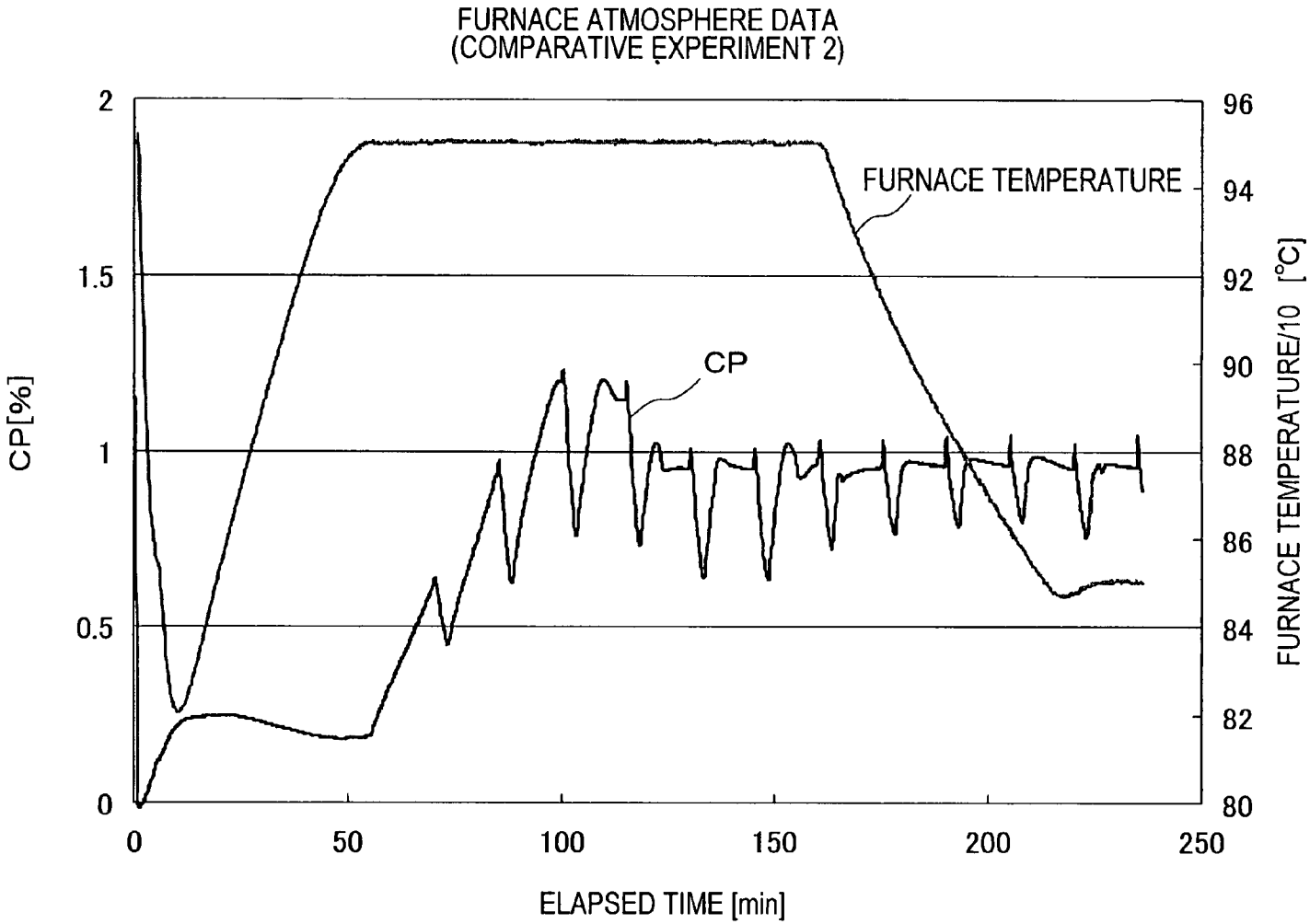
FIG. 13 is a graph showing variations of measured values of a furnace temperature and CP obtained in the comparative experiment 2.
Figure 14:
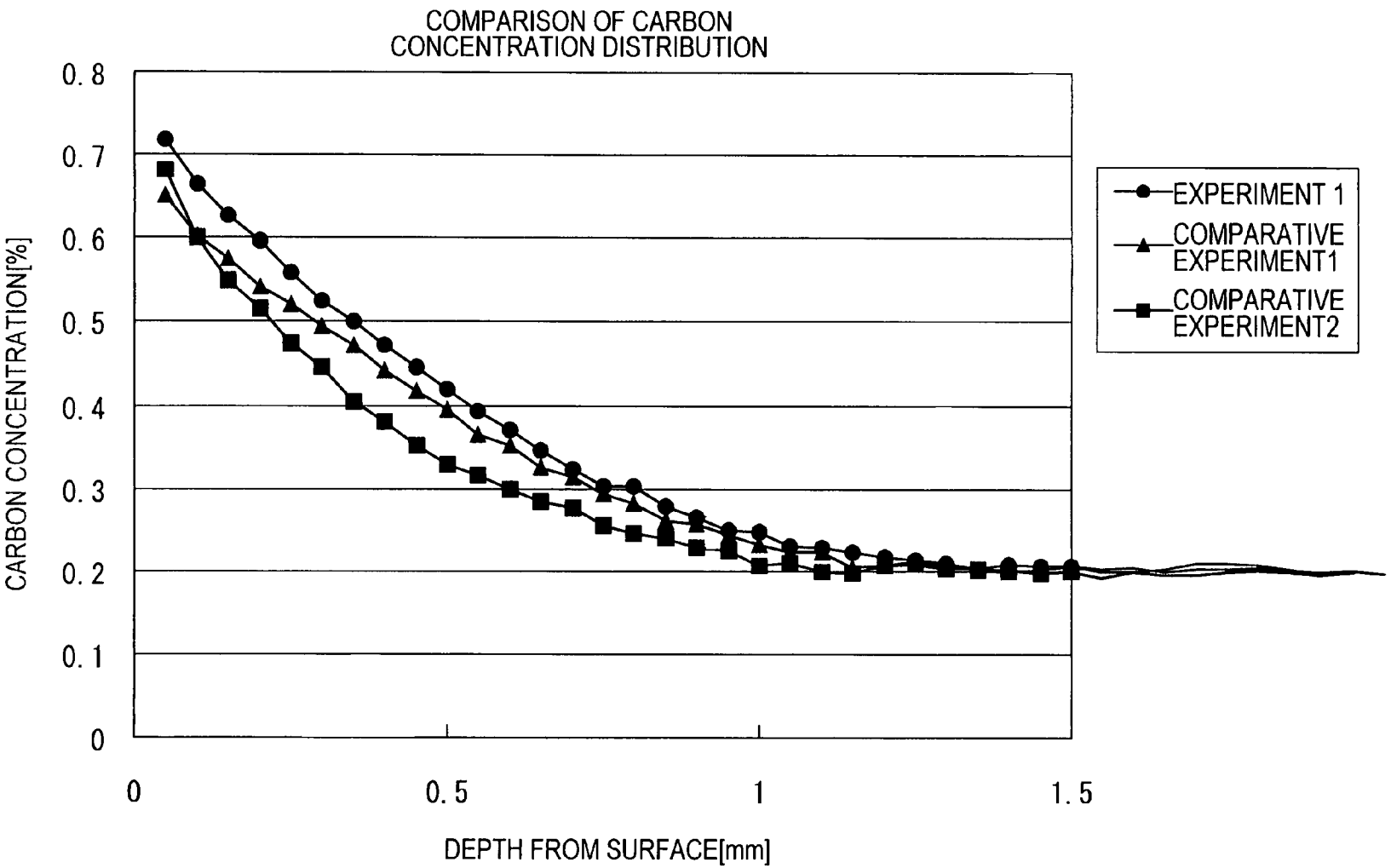
FIG. 14 is a graph showing carbon concentration distributions in a workpiece subjected to treatment of the experiment 1, a workpiece subjected to treatment of the comparative experiment 1, and a workpiece subjected to treatment of the comparative experiment 2.

FIG. 11 is a graph of measured values of furnace temperatures and CP obtained in the experiment 1. FIG. 12 is a graph of measured values of furnace temperatures and CP obtained in the comparative experiment 1. FIG. 13 is a graph of measured values of furnace temperatures and CP obtained in the comparative experiment 2. Note that CP inside the furnace is calculated based on detected values from the oxygen sensors. Due to effects of CH4 (methane) or the like existing inside the furnace, measured CP values in FIG. 11, FIG. 12, and FIG. 13 are higher than actual CP values in the furnace. FIG. 14 shows measured values (mean values) of respective carbon concentration distributions of a workpiece treated in the experiment 1, a workpiece treated in the comparative experiment 1, and a workpiece treated in the comparative experiment 2. As is clear from FIG. 14, in the workpiece treated in the experiment 1, the higher carbon concentration is obtained as compared with the workpiece treated in the comparative experiment 1 and the workpiece treated in the comparative experiment 2. Also, the mean value of ECD (depth of carburization from the surface of a workpiece to a position where carbon concentration is approximately 0.4%) is 0.54 mm in the workpiece treated in the experiment 1, which is 0.49 mm in the workpiece treated in the comparative experiment 1, and thus a difference as large as 0.05 mm is generated (refer to FIG. 15). From the above, it is verified that, by preventing decrease of CP during treatment, the ECD can be improved and the carburization treatment can be performed effectively. Also, in actual sequential type carburization treatment, there may be a case that the frequency of occurrence of CP decrease, namely the frequency of opening/closing the opening for carrying in or out a workpiece, is larger than in the comparative experiments 1 and 2. In such a case, it is conceivable that effects to be obtained by preventing the CP decrease during treatment becomes much larger, and thus it is inferred that the reduction in treatment time or the like can be achieved. Further, from the results of the comparative experiment 1 and the comparative experiment 2, it is also found that, by increasing the target value of CP during carburization (treatment A1 and A1') from 0.9% to 1.1%, the carbon concentration distribution can be improved, and the ECD can be increased by approximately 0.12 mm. Therefore, it is verified that increasing CP during carburization is effective for improving treatment efficiency.

The present invention can be applied to a carburization treatment apparatus.

According to the present invention, by increasing supply flow rate of transforming gas or enriched gas when the opening of the furnace is opened, decrease of CP inside the furnace can be prevented even when air enters the furnace. By stopping feedback control of CP when the opening of the furnace is opened, the CP can be prevented from becoming unstable. Stabilization of CP can be achieved simply without performing complex control setting. By stabilizing CP inside the furnace, carburization treatment can be performed effectively. Furthermore, CP can be stabilized even in an atmosphere with high CP, and thus the carburization treatment can be performed with high efficiency.

What is claimed is:

1. A heat treatment method for supplying transforming gas and enriched gas inside a furnace and heat treating a workpiece inside the furnace, comprising the steps of:

performing feedback control of carbon potential by operating a supply flow rate of the enriched gas based on carbon potential inside the furnace;

stopping the feedback control at any one of before an opening of the furnace is opened, while the opening of the furnace is open and before an atmosphere outside the furnace begins to flow into the furnace, and after the opening of the furnace is opened and before the atmosphere outside the furnace begins to flow into the furnace, and increasing a supply flow rate of the transforming gas from a supply flow rate thereof immediately before the feedback control is stopped; and resuming the feedback control when a furnace pressure reaches a predetermined pressure after the opening of the furnace is closed, wherein the opening is a carry-out port for carrying out a workpiece from the furnace, wherein the predetermined pressure is the furnace pressure before the furnace opens, and wherein increasing the supply flow rate of the transforming gas prevents a decrease of the carbon potential inside the furnace.

2. The heat treatment method according to claim 1, further comprising the step of:

returning, when the furnace pressure reaches the predetermined pressure after the opening of the furnace is closed, the supply flow rate of the transforming gas to the supply flow rate thereof immediately before the feedback control is stopped.

3. The heat treatment method according to claim 1, further comprising the step of:

increasing, when the feedback control is stopped, the supply flow rate of the enriched gas from a supply flow rate thereof immediately before the feedback control is stopped.

4. The heat treatment method according to claim 1, wherein the method further comprising the steps of:

opening the carry-out port of the furnace in a state that an exit of an oil tank chamber provided outside the carry-out port of the furnace is closed and carrying a workpiece into the oil tank chamber; and opening the exit of the oil tank chamber after the carry-out port of the furnace is closed and carrying out the workpiece from the oil tank chamber.

5. A heat treatment method for supplying transforming gas and enriched gas inside a furnace and heat treating a workpiece inside the furnace, comprising the steps of:

performing feedback control of carbon potential by operating a supply flow rate of the enriched gas based on carbon potential inside the furnace;

stopping the feedback control at any one of before an opening of the furnace is opened, while the opening of the furnace is open and before an atmosphere outside the furnace begins to flow into the furnace, and after the opening of the furnace is opened and before the atmosphere outside the furnace begins to flow into the furnace and increasing a supply flow rate of the transforming gas from a supply flow rate thereof immediately before the feedback control is stopped;

resuming the feedback control when a furnace pressure reaches a predetermined pressure after the opening of the furnace is closed;

returning, when the furnace pressure reaches the predetermined pressure after the opening of the furnace is closed, the supply flow rate of the transforming gas to the supply flow rate thereof immediately before the feedback control is stopped;

increasing, when the feedback control is stopped, the supply flow rate of the enriched gas from a supply flow rate thereof immediately before the feedback control is stopped;

opening the carry-out port of the furnace in a state that an exit of an oil tank chamber provided outside the carry-out port of the furnace is closed and carrying a workpiece into the oil tank chamber; and opening the exit of the oil tank chamber after the carry-out port of the furnace is closed and carrying out the workpiece from the oil tank chamber, wherein the opening is a carry-out port for carrying out a workpiece from the furnace.

* * * * *